US008316990B2

(12) United States Patent
Uhlig et al.

(10) Patent No.: US 8,316,990 B2
(45) Date of Patent: Nov. 27, 2012

(54) FALL ARREST SELF RESCUING TROLLEY AND SYSTEM INCLUDING THE SAME

(75) Inventors: Richard Uhlig, Naples, FL (US); Arnold Timothy Galpin, Morgantown, PA (US); David A. Pisotti, Mohnton, PA (US)

(73) Assignee: Transol Corporation

( * ) Notice: Subject to any disclaimer, the term of this patent is extended or adjusted under 35 U.S.C. 154(b) by 225 days.

(21) Appl. No.: 12/500,897

(22) Filed: Jul. 10, 2009

(65) Prior Publication Data

US 2011/0005861 A1 Jan. 13, 2011

(51) Int. Cl.
*A62B 35/00* (2006.01)

(52) U.S. Cl. ..... 182/36; 104/115

(58) Field of Classification Search ..... 182/36; 104/113, 115

See application file for complete search history.

(56) References Cited

U.S. PATENT DOCUMENTS

| | | | | |
|---|---|---|---|---|
| 2,170,689 | A * | 8/1939 | Loomis | 182/36 |
| 6,269,904 | B1 | 8/2001 | Morhaus | |
| 6,334,507 | B1 | 1/2002 | Westerweel | |
| 6,378,651 | B1 | 4/2002 | Ecker et al. | |
| 6,467,574 | B2 | 10/2002 | Lara | |
| 6,488,118 | B1 | 12/2002 | Corriveau | |
| 6,547,033 | B1 | 4/2003 | Cheval | |
| 6,837,337 | B2 | 1/2005 | Thomas et al. | |
| 7,111,707 | B2 | 9/2006 | Reeves | |
| 7,341,159 | B2 | 3/2008 | Nelson | |
| 7,347,300 | B2 | 3/2008 | Renton et al. | |
| 2004/0238277 | A1 * | 12/2004 | Kruse | 182/36 |
| 2006/0156944 | A1 | 7/2006 | Vetesnik | |

* cited by examiner

*Primary Examiner* — Katherine W Mitchell
*Assistant Examiner* — Daniel Cahn
(74) *Attorney, Agent, or Firm* — Belles Katz LLC

(57) ABSTRACT

A trolley and fall arrest safety system is disclosed for movement along an elevated track to support a person who has fallen off of a structure adjacent the track. The trolley is arranged to roll on along a surface of the track in a longitudinal direction to suspend a person therefrom in the event that the person falls from an elevated position adjacent the track. The trolley includes an immobilizing assembly including a flexible strap. The strap is arranged to be pulled by the suspended worker to releasably fix the trolley at a longitudinal position on the track, so that the person can swing himself/herself to move the trolley to a desired safety position.

25 Claims, 8 Drawing Sheets

Fig. 11
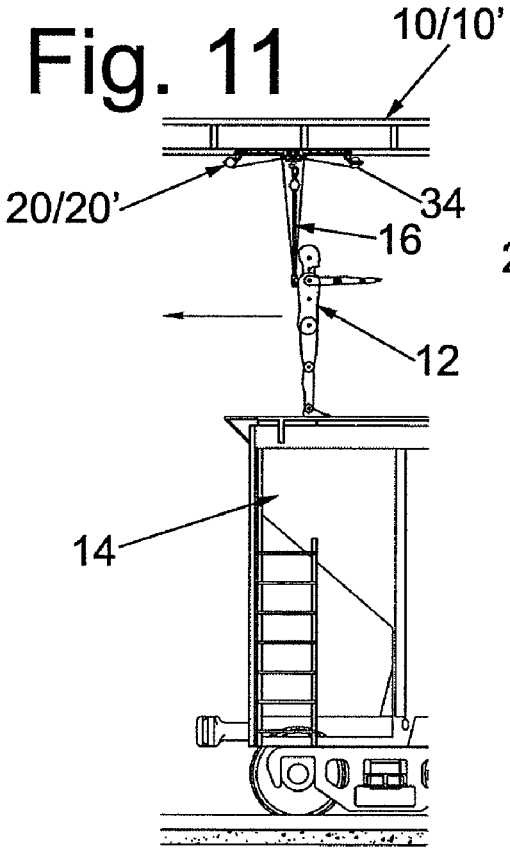
Fig. 12
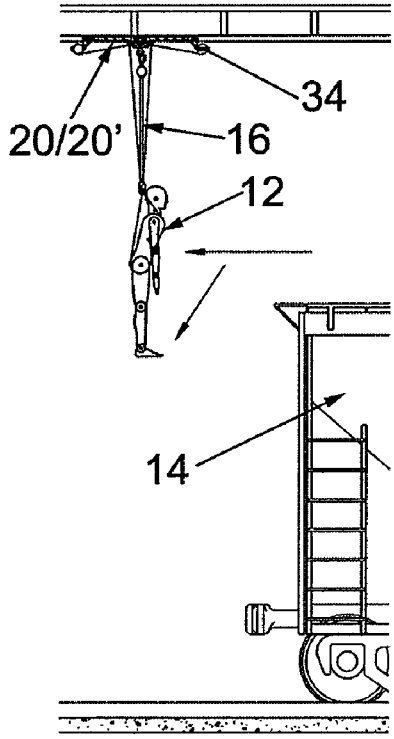
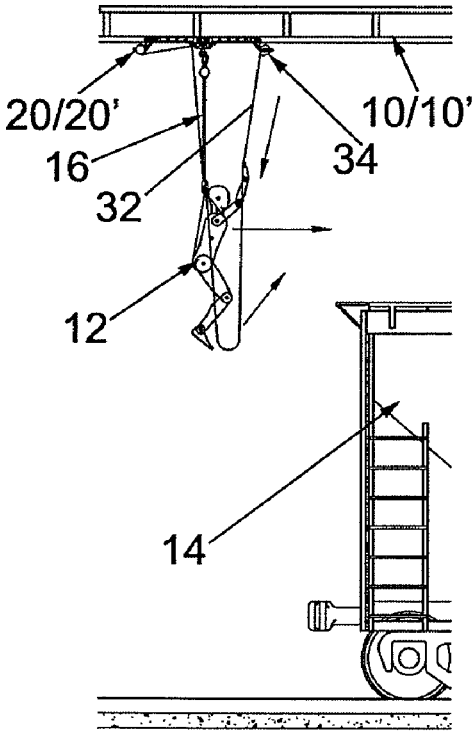
Fig. 13
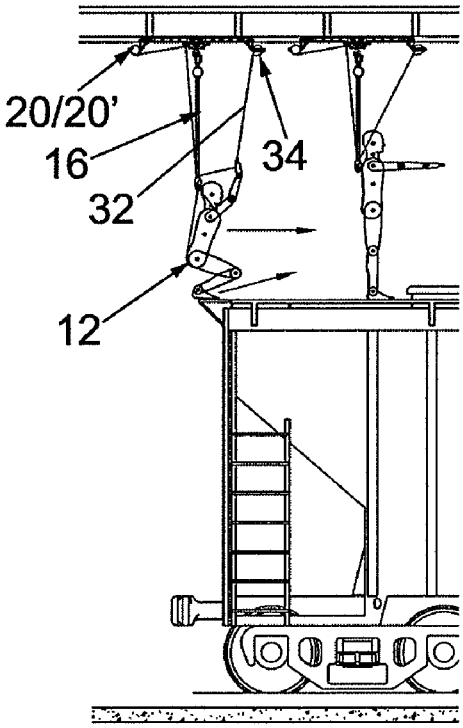
Fig. 14

FALL ARREST SELF RESCUING TROLLEY AND SYSTEM INCLUDING THE SAME

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to fall protection systems and more particularly to trolleys for use on any elevated track to enable a person suspended therefrom to manually move himself/herself to safety.

BACKGROUND OF THE INVENTION

Fall protection systems, or fall arrest systems, are commonly used to prevent accidents involving falls from elevated work environments, e.g., the tops of railroad cars, tanker trucks, etc., or from stationary structures, such as rooftops of buildings, silos and other structures that, while being traversed, provide fall hazards. To that end, it is a common practice for workers to wear a harness that is attached to a support assembly by means of a cable known as a lanyard or "lifeline." The safety harness is normally manufactured of nylon webbing material and is designed to distribute the loading stresses of a fall to prevent serious injury to the worker.

In order to enable the worker to move readily about the vehicle or structure being traversed many fall protection systems include a rolling trolley to which the worker is tethered by a retractable lanyard and associated safety harness. In some systems the trolley is mounted to roll along an elevated cable (steel or synthetic material) that is strung between two or more anchor points. Other systems make use of an elevated track, e.g., I-beam, on which the trolley is mounted. The trolley in the I-beam system is typically a four-wheeled device that is designed to ride on the lower leg or flange of the I-beam, and includes an attachment point to secure the lifeline to the trolley.

Examples of prior art fall protection systems are shown and described in the following U.S. patents.

U.S. Pat. No. 6,269,904 (Morhaus) discloses a rail assembly having an I-beam supported on the bottom of a truss member which is mounted between support members over the elevated surface being worked on. A trolley is provided with wheels arranged to engage an upper side of the bottom flange of the I-beam such that the trolley can move along the I-beam in response to movement of the attached worker.

U.S. Pat. No. 6,334,507 (Westerweel) discloses a cable assembly having parallel and generally horizontal anchoring lines spaced apart above the elevated surface. A trolley is provided with rollers arranged to allow movement along the longitudinal anchoring lines.

U.S. Pat. No. 6,467,574 (Lara) discloses a sliding member for use with a horizontal life-line including a cable extending along a wall and connected thereto by supports. The sliding member includes a body having a channel in which the cable slides and a handle adapted to receive one end of a lanyard whose other end is connected to a safety harness. A movable jaw is provided as part of the sliding member and is adapted to form a slot in the channel to enable the sliding member to be mounted on the cable. The sliding member also includes a mechanism for holding the movable jaw slightly open in an intermediate first configuration to form a slot having a thickness greater than the thickness of supports for the cable and a device for opening the movable jaw to increase the size of the slot in an open second configuration. When the sliding member is In the open second configuration it is adapted to be mounted on the cable. An element for automatically placing the sliding member in a safety configuration if traction is applied to the handle is also included. That element enables the movable jaw to pivot so that the slot is completely blocked.

U.S. Pat. No. 7,347,300 (Renton) discloses a traveler for a fall arrest system including a body having a bore and a slot narrower than the bore linking the bore to the exterior of the body. A load member is connected to the body for pivotal movement relative to the body and suitable for attachment to fall safety equipment.

U.S. Published Application No. 2006/0156944 discloses a rail and trolley apparatus having a trolley movable along a horizontally supported rail assembly for use as a fall protection system. The trolley includes a pair of wheels arranged to engage opposing bearing surfaces in each of two channels provided in the rail assembly. Each bearing surface has a central portion and two side portions shaped to fit flush against a curved edge surface of each wheel. This allows the wheels to bear against the surfaces in multiple directions, thereby allowing rolling motion of the trolley along the rail assembly as well as loading of the trolley in any direction not parallel to that motion to enable the apparatus to be oriented at any angle about a longitudinal axis thereof during installation.

Other U.S. patents disclosing fall arrest systems are U.S. Pat. No. 6,378,651 (Ecker et al.); U.S. Pat. No. 6,488,118 (Corriveau); U.S. Pat. No. 6,547,033 (Cheval); U.S. Pat. No. 6,837,337 (Thomas et al.); U.S. Pat. No. 7,111,707 (Reeves); and U.S. Pat. No. 7,341,159 (Nelson).

While the aforementioned prior art systems employing a movable trolley may be generally suitable for their intended purpose of preventing a falling worker from being injured, such systems merely address the issue of preventing the worker from falling to the ground, i.e., they suspend the worker from the elevated track or cable until help arrives. These prior art systems do not enable the worker to move himself/herself along the elevated track to some safe position from which the worker can dismount after their fall has been arrested. In particular, even though the prior art trolleys are arranged to readily roll along the track, the person suspended from such a trolley cannot move it along the track or cable unless there is some stationary structure located within reach of the worker to which he/she may grasp to pull or push against. Merely swinging one's body when suspended from a movable trolley will not effect the movement of the trolley along the track.

Thus, a need presently exists for a fall arresting system trolley which enables a person suspended from the trolley to move it along the track to a position of safety. The subject invention addresses that need.

All references cited herein are incorporated herein by reference in their entireties.

SUMMARY OF THE INVENTION

In accordance with one aspect of this invention there is provided a trolley for movement along an elevated track to support a person who has fallen off of a structure adjacent the track. The trolley comprises a frame having at least one roller, a connector mounted on the frame, and a trolley immobilizing assembly mounted on the frame. The at least one roller is arranged for enabling the trolley to roll along a surface of the track in a longitudinal direction. The connector is arranged to have a lanyard releasably secured to it, with the lanyard being connected to a safety harness worn by the person to suspend the person from said trolley.

The trolley immobilizing assembly (e.g., an operable track engaging assembly in the form of a spring-biased, movable frictional engagement member or locking bar and associated flexible strap) is mounted on the frame and is arranged so that a person pulling on the strap can releasably fix said trolley at a longitudinal position on the track, whereupon that the person can swing below the trolley while fixed in the longitudinal position on the track and thereafter release said strap, whereupon the release of said strap releases the trolley from its fixed position on the track so that the momentum of the swing of the person moves said trolley along the track to another longitudinal position thereon.

In some exemplary embodiments the operable track engaging assembly is mounted on the frame spaced from the at least one roller and comprises the heretofore identified movable frictional engagement member and a strap. The movable frictional engagement member is normally biased away from the track and arranged to be pulled into frictional engagement with the track by the person pulling on the strap to releasably fix the trolley at a longitudinal position on the track. In those exemplary embodiments the trolley also includes a retractor coupled to the movable frictional engagement member to retract the strap and a release mechanism for holding the strap in a stowed state until the strap is ready to be used to immobilize the trolley.

DESCRIPTION OF THE DRAWING

FIGS. 11-14 are a series of illustrations showing an exemplary use of a fall arrest, safety system including a trolley constructed in accordance with this invention.

DETAILED DESCRIPTION OF THE PREFERRED EMBODIMENT

Figure 1:
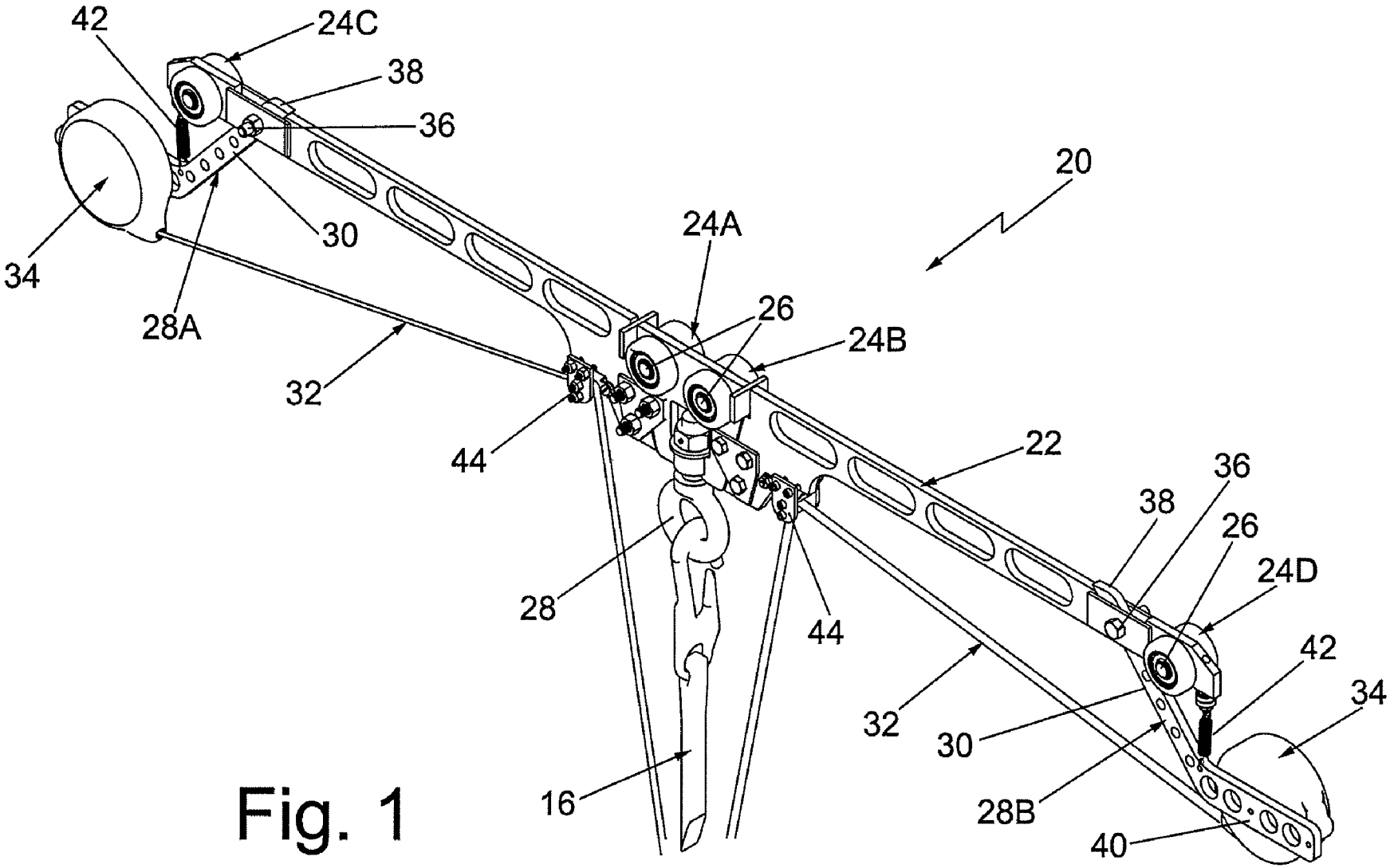
FIG. 1 is an isometric view showing one exemplary fall arrest self rescuing trolley constructed in accordance with this invention, i.e., a trolley for use on an enclosed track.

Referring now to the various figures of the drawing wherein like reference characters refer to like parts, there is shown at 20 in FIG. 1 one exemplary embodiment of a fall arrest self rescue trolley of a fall arrest safety system constructed in accordance with this invention. The trolley 20 is arranged for mounting and movement along an elevated track 10 (FIGS. 2 and 2A) located adjacent the structure e.g., rail car 14 (FIGS. 11-14) on which a worker 12 is working and serves to support the worker in case he/she falls off of the structure to prevent the worker from being injured in the fall. To that end, a conventional retractable lanyard 16 (FIGS. 11-14) and a conventional safety harness (not shown) worn by the worker is connected to the trolley 20. The lanyard, harness and elevated track form a portion of the fall arrest safety system. Unlike prior art trolleys, each trolley of this invention is constructed so that the worker can operate the trolley to move himself/herself from the position at which he/she is suspended after a fall to some other position, e.g., a safety position from which the worker can descend, all without requiring the help or assistance of anyone else.

Figures 2, 2A, 2B:
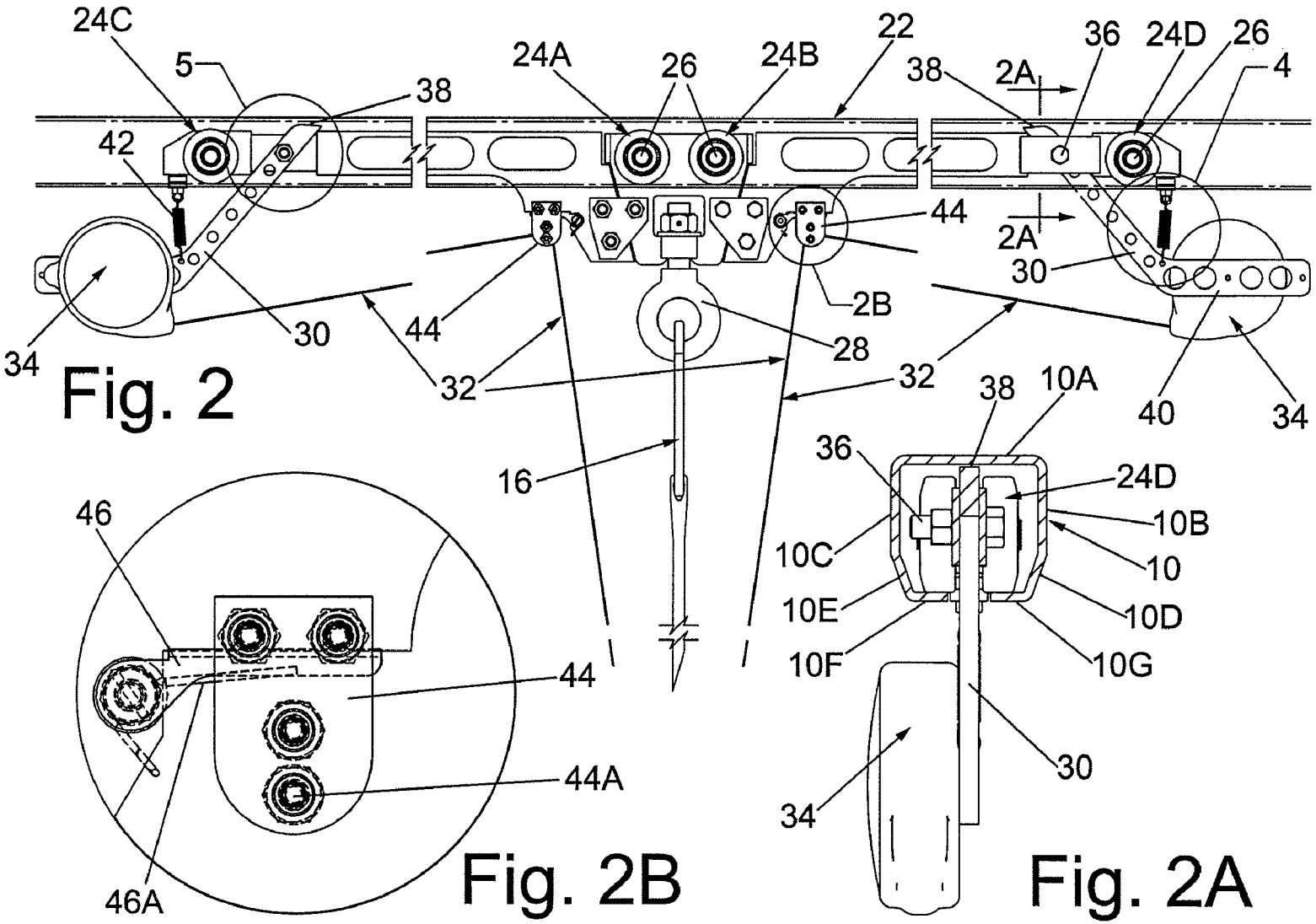
FIG. 2 is a side elevation view partially broken away, of the trolley shown in FIG. 1 mounted on an enclosed track.
FIG. 2A is an enlarged sectional view taken along line 2A-2A of FIG. 2.
FIG. 2B is an enlarged side elevation view of the portion of the trolley shown within the circle 2B in FIG. 2.
Figure 3:
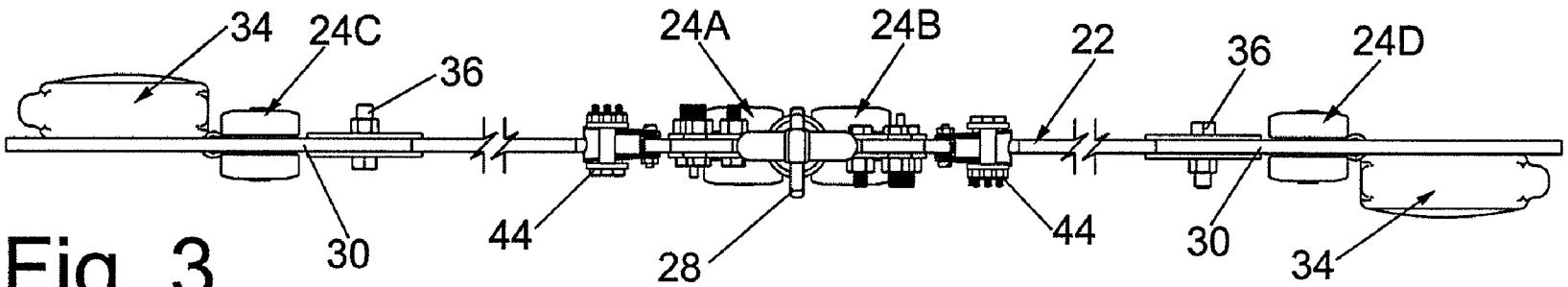
FIG. 3 is a top plan view, partially broken away, of the trolley shown in FIG. 1.

As best seen in FIGS. 1 and 2 the trolley 20 basically comprises an elongated frame 22 formed of any suitable strong material, e.g., steel, aluminum, etc. The frame 22 includes a central section on which two pairs of rollers 24A and 24B are mounted via respective axles 26. Another pair of similarly constructed rollers 24C is mounted at one end of the frame and still another pair of similarly constructed rollers 24D is mounted at the opposite end of the frame. Each of the rollers of each pair is formed of a tough, wear resistant material, such as polyamide, but can be formed of any other material used in conventional enclosed track trolleys.

Each of the rollers of each pair is arranged to roll on a respective flange portion of the elevated track 10. In particular, as best seen in FIG. 2A, the track 10 is of a conventional "enclosed-type" construction. One particularly suitable enclosed track is that sold by SPANCO, a division of Transol Corporation, the assignee of this invention. The track 10 is an elongated member that is formed of a strong material, e.g., steel, and has a horizontally disposed top wall 10A, a pair of vertical sidewalls 10B and 10C projecting downward from the top wall, a pair of angularly located sidewalls 10D and 10E located below the vertical sidewalls, respectively, and a pair of horizontally disposed flanges 10F and 10G projecting inward from the ends of the angularly located sidewalls, respectively, to form a slot therebetween. The track 10 is arranged to support the trolley 20 to enable the trolley to be moved along the track to any desired longitudinal position by the user (as will be described later). In particular, the rollers of the pair 24D are arranged to roll along respective flanges 10F and 10G of the track 10. In a similar manner the rollers of the pair 24C are arranged to roll along respective flanges 10F and 10G of the track 10, while the rollers of the pair 24A and the rollers of the pair 24B also roll along respective flanges 10F and 10G of the track. Thus, the trolley 20 can be moved (rolled) to any longitudinal position along the length of the track 10.

A swivel eyelet 28 is mounted on the frame 22 immediately below the central roller pairs 24A and 24B. The eyelet 28 serves as the connection point to which a conventional retractable lanyard 16 and its associated safety harness (not shown) may be secured, as best seen in FIGS. 1 and 2. Thus, when a worker 12 is wearing a safety harness that is connected via a retractable lanyard 16 to the eyelet 28, he/she will be protected from injury in the event of a fall. In such an event the retractable lanyard will act in its normal manner to arrest the fall, whereupon the worker will be suspended from the trolley 20 at the particular longitudinal position on the track that the trolley is located when the worker's fall is arrested.

As mentioned earlier, the trolley 20 of this invention is arranged to be operated by a worker suspended from it to move it along the track to a position of safety. To that end, the trolley 20 includes at least one trolley immobilizing assembly which is arranged when actuated to fix or immobilize the trolley on the track and to hold the trolley in that position until its release is desired. In the exemplary embodiments shown herein each trolley includes two trolley immobilizing assemblies 28A and 28B. Each of these exemplary assemblies serves to releasably engage the track when operated to releasably fix the trolley in position on the track to enable the suspended worker to pull himself/herself along the track. In particular, one track engaging assembly 28A is mounted on the frame 22 at one end thereof to enable a suspended worker to move in the direction toward that end of the trolley, while the other and identically constructed track engaging assembly 28B is mounted on the opposite end of the frame 22 to enable a suspended worker to move in the direction toward the opposite end of the trolley.

Figure 5:
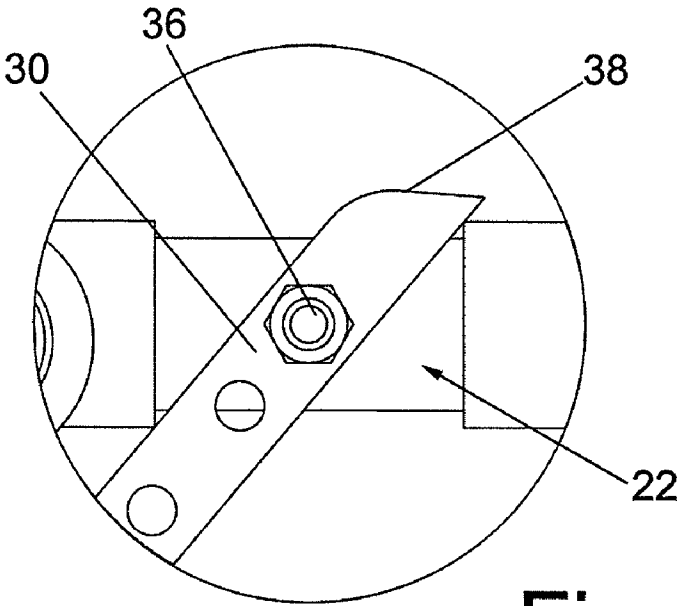
FIG. 5 is an enlarged side elevation view of the portion of the trolley shown within the circle 5 in FIG. 2.
Figure 4:
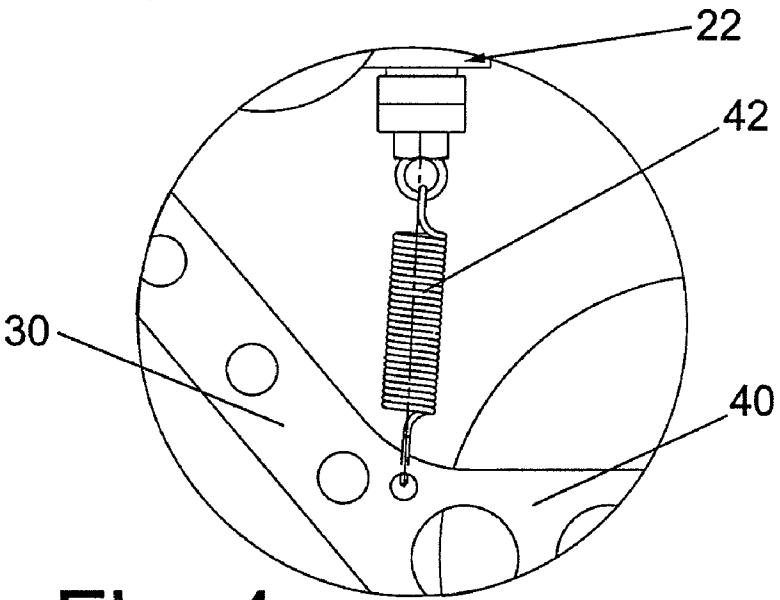
FIG. 4 is an enlarged side elevation view of the portion of the trolley shown within the circle 4 in FIG. 2.

The track engaging assemblies 28A and 28B are identical in construction and operation and each assembly basically comprises a movable frictional engagement member 30, a flexible strap 32 and a retractor 34. The movable frictional engagement member 30 is in the form of a locking bar which is pivotally mounted adjacent a respect end of the frame 22 via a respective pivot pin, e.g., a bolt 36. Each locking bar 30 includes an arcuate working end 38 (FIG. 5) which is arranged to be pivoted into frictional engagement with a portion of the inside surface of the top wall 10A of the track 10. The opposite end of each locking bar 30 is in the form of an angularly extending arm 40. A respective tension spring 42 (FIG. 4) is provided to normally bias its associated locking bar so that the working end 38 of that locking bar is spaced from and not in frictional engagement with top wall of the track. As best seen in FIG. 4, each biasing spring 42 is mounted between the associated free end of the frame 22 and the point on the associated locking bar from which the arm 40 extends.

Each locking bar 30 is arranged to be pivoted by the user (i.e., a suspended worker) by means of the strap 32 into its operative orientation wherein its free end frictionally engages the top wall of the track. To that end, one strap 32 extends from a point at which it is affixed to the retractable lanyard 16 to the retractor 34 at one end of the frame 22. The other strap extends from a point at which it is affixed to the retractable lanyard 16 to the retractor 34 at the opposite end of the frame 22. Each retractor is mounted adjacent the free end of the arm 40 of the associated locking bar and basically comprises an internal reel on which a portion of the associated strap 32 is wound. The reel is internally biased so as to naturally wind up the strap on it.

In order to keep each strap out of the way of the worker (to stow the strap) until it is necessary to use it, the trolley 20 includes a pair of releasable guide assemblies 44 (FIG. 2B), each of which includes a pin 44A over which a portion of the associated strap 32 extends. In particular, one guide assembly 44 is mounted on the frame 22 below and slightly beyond the center roller pair 24A and the other guide assembly is mounted on the frame below and slightly beyond the center roller pair 24B. Thus, each of the straps 32 extends generally horizontally close to the track 10 from its associated retractor over the pin 44A of the associated guide assembly 44 and from that point downward generally vertically close to the retractable lanyard 16 to its connection point (not shown) on the lanyard. Each guide assembly 44 is releasably secured to the frame 22 by a respective pivotable finger 46 which is biased by a spring 46A.

Figure 6:
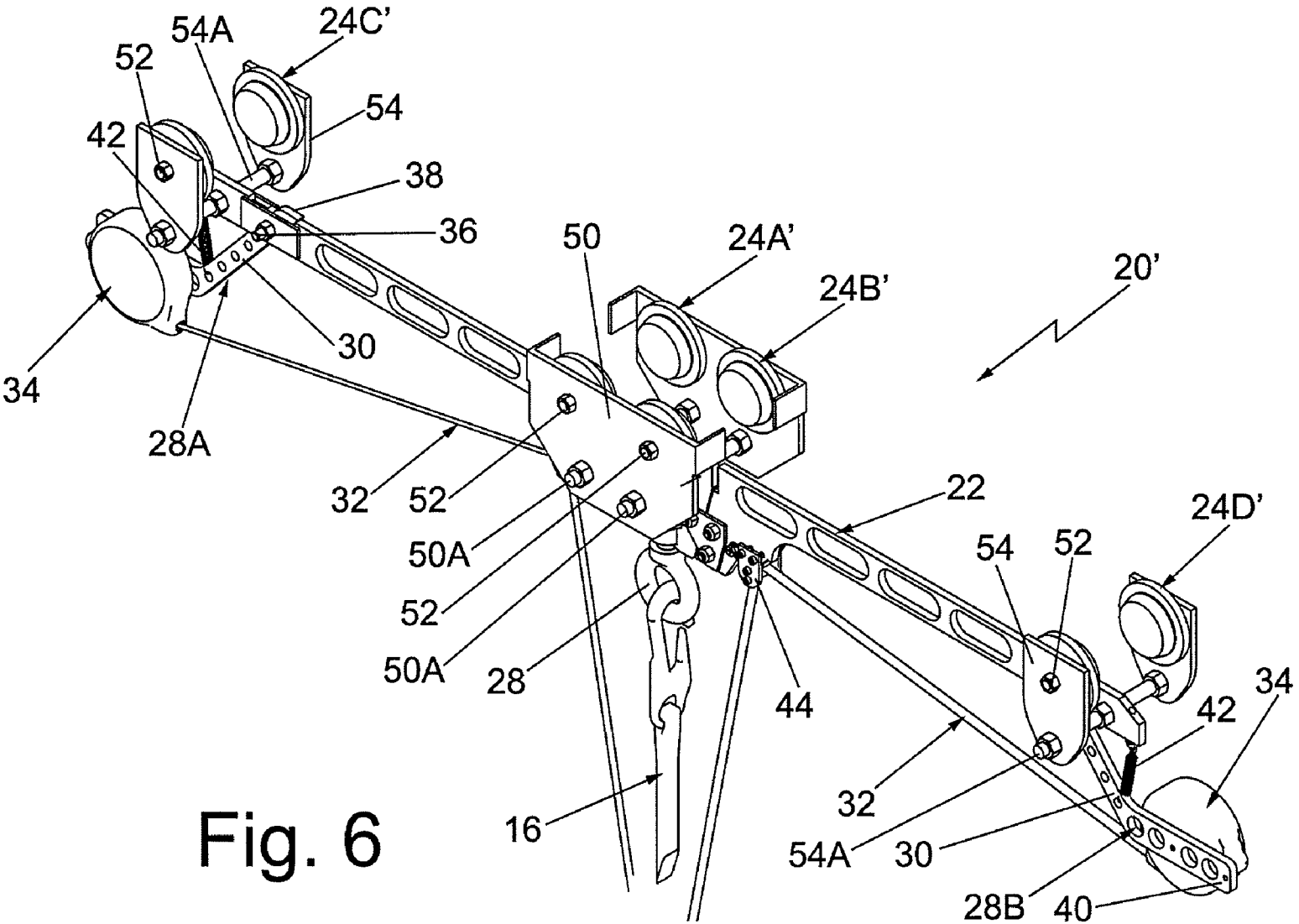
FIG. 6 is an isometric view showing another exemplary fall arrest self rescuing trolley constructed in accordance with this invention, i.e., a trolley for use on an I-beam.
Figure 7:
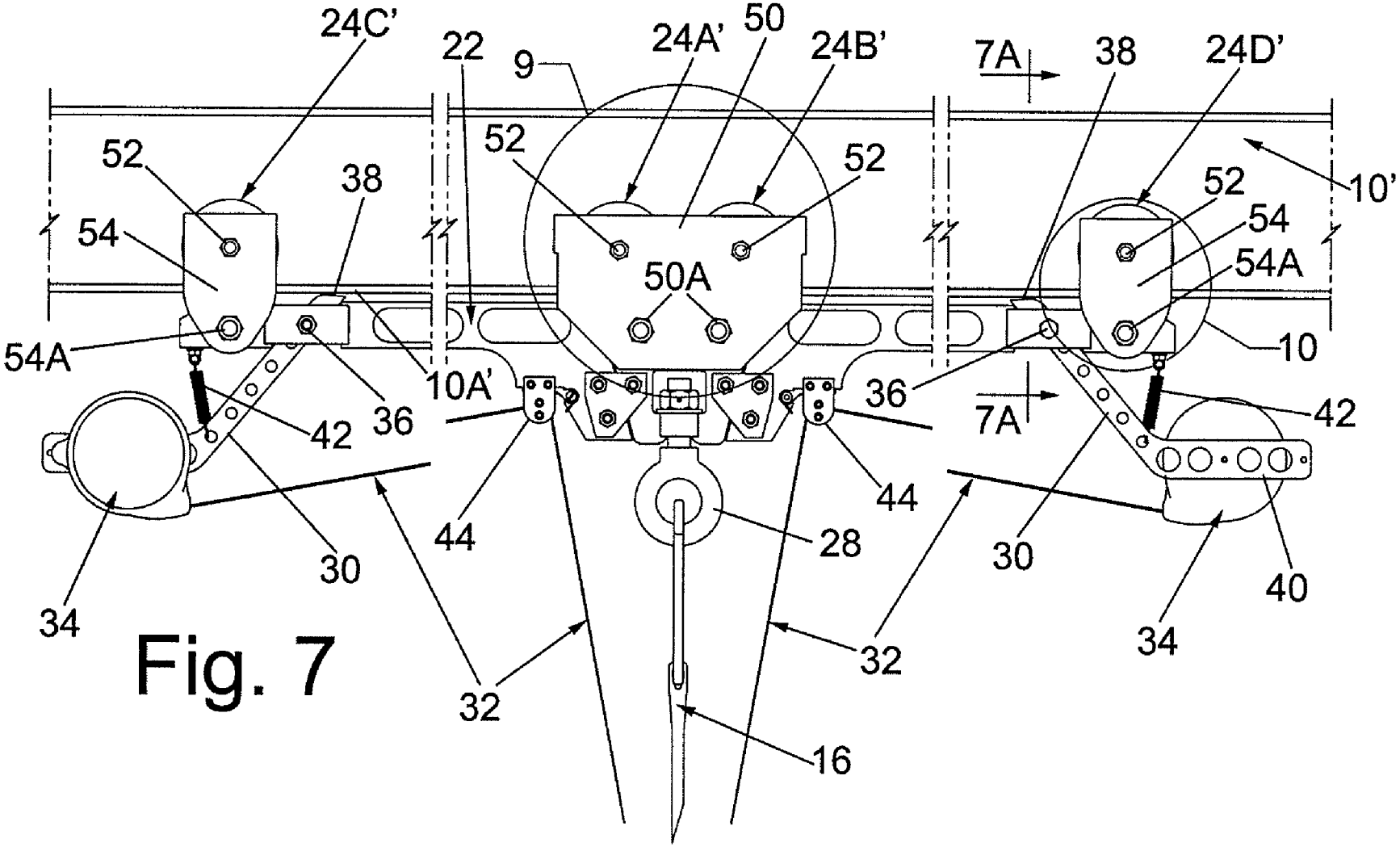
FIG. 7 is a side elevation view partially broken away, of the trolley shown in FIG. 6 mounted on an I-beam.
Figure 7A:
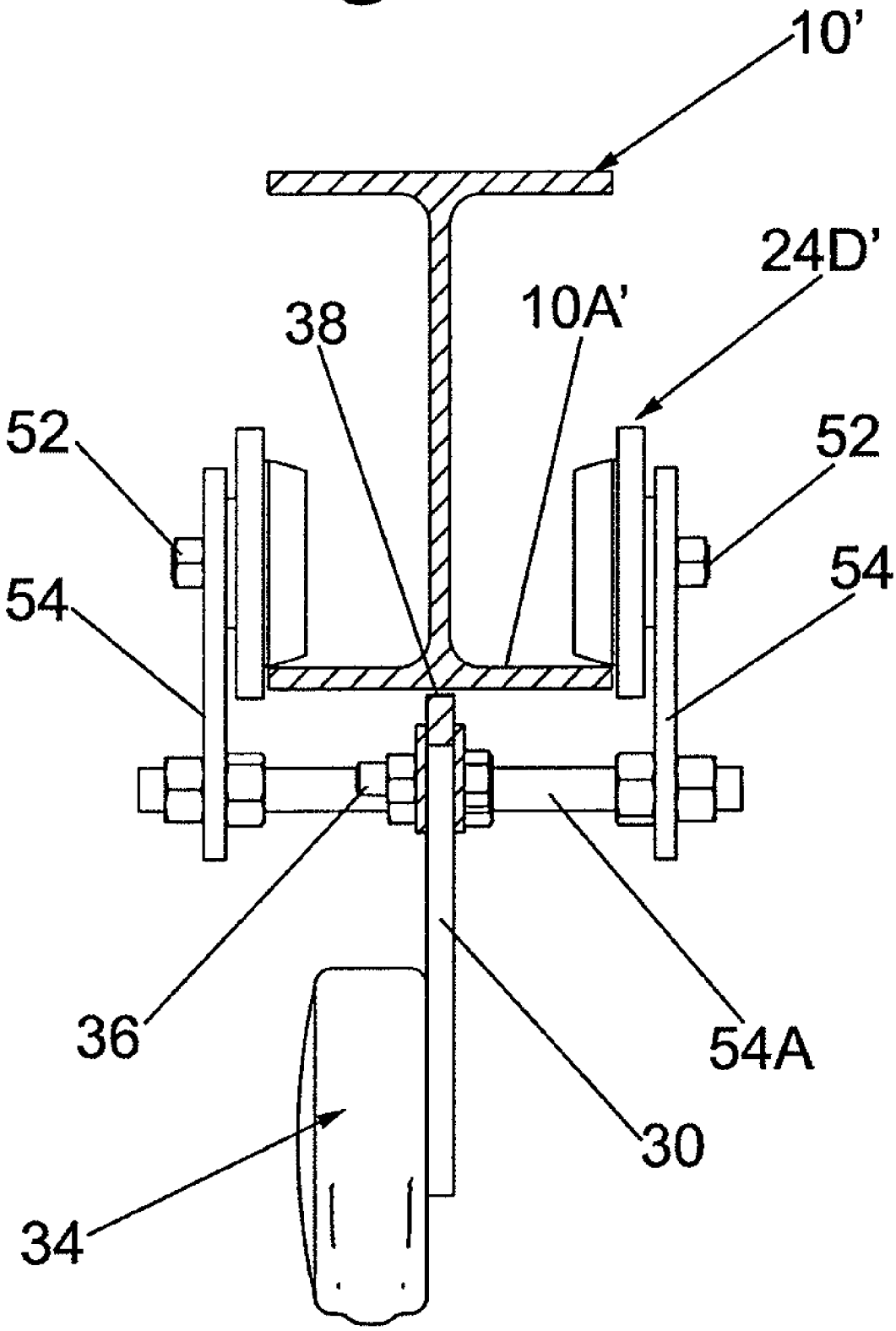
FIG. 7A is an enlarged sectional view taken along line 7A-7A of FIG. 7.
Figure 8:
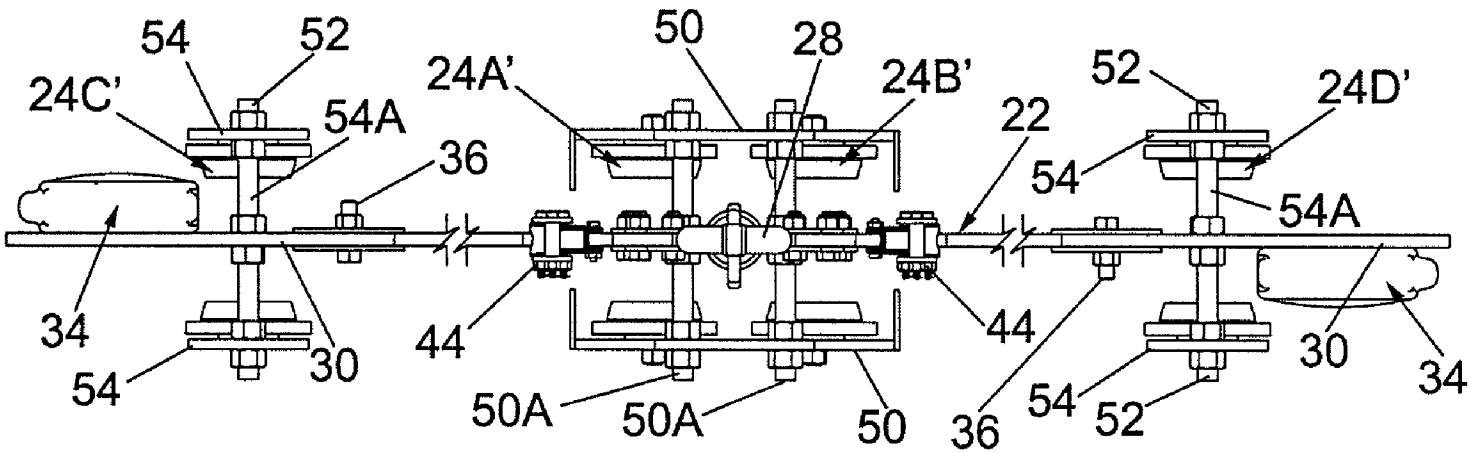
FIG. 8 is a top plan view, partially broken away, of the trolley shown in FIG. 7.
Figure 10:
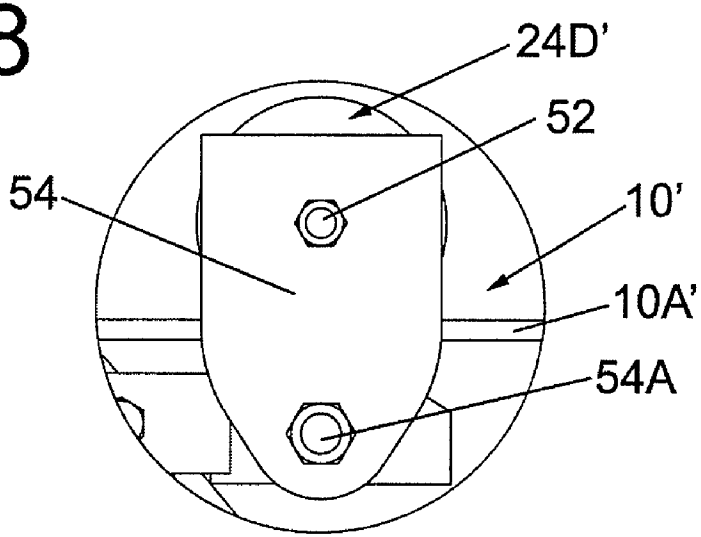
FIG. 10 is an enlarged side elevation view of the portion of the trolley shown within the circle 10 in FIG. 7.
Figure 9:
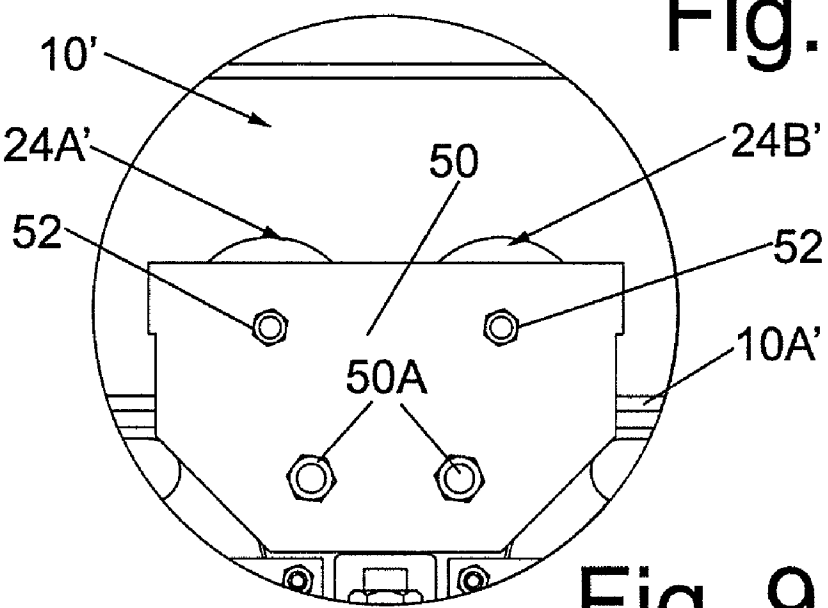
FIG. 9 is an enlarged side elevation view of the portion of the trolley shown within the circle 9 in FIG. 7.

Referring now to FIGS. 6-10, the details of an alternative embodiment of a trolley 20' constructed in accordance with this invention will now be described. The trolley 20' is arranged for use on an I-beam type of track 10', like shown in FIG. 7A, and is of the same basic construction as the trolley 20, except for the rollers and their mountings. In the interest of brevity the common components of the trolleys 20 and 20' will be given the same reference numbers and a description of their construction and operation will not be reiterated. Thus as can be seen in FIGS. 6 and 7, the frame 22 of the trolley 20' includes a central section on which two pairs of rollers 24A' and 24B' are mounted via respective axles mounting plates 50 and associated axle bolts 52. The plates are held together by a pair of threaded rods 50A. Another pair of similarly constructed rollers 24C' is mounted at one end of the frame via respective mounting plates 54 and axle bolts 52. The plates 54 are held together by a threaded rod 54A. Still another pair of similarly constructed rollers 24D' is mounted in a similar manner at the opposite end of the frame 22. Each of the rollers of each pair is formed of a tough, wear resistant material, such as polyamide, but can be formed of any other material used in conventional enclosed track trolleys. Each of the rollers of each pair is contoured and arranged to roll on the edge of a respective lower flange portion of the I-beam that forms the elevated track 10' as shown clearly in FIG. 7A.

Operation of a trolley constructed in accordance with this invention will now be described with reference to the illustrations in FIGS. 11-14. In particular, those figures show the use of a system to protect a worker 12 from falling off of a railroad car 14. The worker 12 is wearing a conventional harness (not shown) that is connected by a conventional self-retractable lanyard 16 to the trolley 20/20'. The trolley in this example is shown mounted on an elevated track 10/10'. The track can be of the enclosed track type like shown in FIGS. 1-5 or can be of the I-beam type like shown in FIGS. 6-10, or on other types of beams, such as H-beams, W-beams (for "wide flange"), rolled steel joist (RSJ), or double-T, or can be used on an on any other elongated support member having a flange or surface along which the roller(s) of a trolley constructed in accordance with this invention can roll.

In the exemplary use of the trolley 20/20' shown in FIGS. 11-14, it shall be assumed that the worker 12 is working on the top of the rail car 14, as shown in FIG. 11, and has moved too close to the edge of the rail car so that he/she slips and loses his/her balance and falls off of the rail car. The person is prevented from falling to the ground, i.e., his/her fall is arrested, by the safety harness and lanyard that are connected to the trolley 20/20'. It is likely that the momentum of the person falling off of the back of the rail car will push the person away from the rail car (and hence from safety) as shown by the arrows in FIG. 12. If the trolley suspending the person is of a conventional type, the person would be stuck in that position out of reach of the rail car so that there would be nothing for him to grab onto to push or pull on to safety. In contradistinction, the fall arrest self rescue trolleys of this invention enable the suspended worker to readily move himself/herself along the track 10/10' back to some safe location, e.g., the rail car or some other structure adjacent to the track. To that end, once the person's fall has been arrested, the person merely has to reach up to activate a respective one of the track engaging assemblies as shown in FIG. 13. In particular, the person pulls on the strap 32 that is facing in the direction that he/she wishes to move, e.g., in the direction of the horizontal arrow shown in FIG. 13. Pulling on that strap causes it to unreel from its associated retractor 34. When the strap has been fully unreeled from the retractor, further pulling on the strap applies a downward force on the spring biased retaining finger 46 (FIG. 2B). This action overcomes the bias on the finger, whereupon it pivots downward to release the guide assembly 44, whereupon the guide assembly falls away. Further pulling on the strap 32 by the person causes it to pivot the associated locking bar 30 about the bolt 36, whereupon the working end 36 of the locking bar moves into frictional engagement with the top wall 10A/bottom flange 10A' of the track. This action effectively locks the trolley in place giving the person an anchor point to which he/she can pull himself/herself. In particular, the person merely has to pull on the strap and swing himself/herself forward toward the anchored end of the trolley, e.g., toward the rail car as shown by the arrows in FIG. 13. Once the swing begins the person can release the strap 32, whereupon the bias of the spring 42 causes the locking bar 30 to pivot back, i.e., disengage, from the track 10/10' so that the momentum of the swing of the person moves the trolley 20 along the track to a longitudinal position closer to desired direction of travel, e.g., toward the rail car. This action can be repeated as often as necessary until the person reaches the rail car. At that point all that the person has to do is to pull on the strap 32 to reengage the locking bar. Once so engaged, the person can pull himself/herself back up on the rail car by pulling on the strap 32 as shown in FIG. 14.

It should be pointed out at this juncture that while the member for pulling the locking arm into frictional engagement with the track has been disclosed as being a strap, such a component is merely exemplary of various elongated flexible members which can be used, e.g., cables, straps, filaments, etc. Thus, the use of the term strap herein is meant to cover such alternative components. Moreover, while the use of retractors, guides and associated components to hold the straps out of the way of the worker until necessary, is preferable, it is not mandatory. Thus, trolleys can be constructed in accordance with this invention without any such means for stowing the straps.

Further still, while the mechanism to releasably lock the trolley in position has been shown and described as being manually actuable (e.g., the straps arranged to be pulled by a suspended worker), it should be clear that any suitable automatic means can be used in lieu of the manually actuable means. Moreover, the mechanisms for releasably locking the trolley in position need not be limited to those assemblies that frictionally engage the track. In fact, the assemblies for releasably locking the trolley in position on the track need not engage the track at all, e.g., such assemblies may prevent rolling of the trolley on the track by locking one or more of the rollers via an actuatable brake, wheel chock or other device for preventing the trolley from rolling along the track.

As should be appreciated by those skilled in the art from the foregoing, the trolleys of this invention can be original equipment or may be produced by retrofitting existing rollable trolleys with one or more trolley immobilizing assemblies constructed in accordance with this invention to releasably fix the trolley in position on a track when such action is desirable.

Without further elaboration the foregoing will so fully illustrate our invention that others may, by applying current or future knowledge, adopt the same for use under various conditions of service.

We claim:

1. A trolley for movement along an elevated track to support a person who has fallen off of a structure adjacent the track, said trolley comprising a frame having at least one roller, a connector mounted on the frame, and at least one trolley immobilizing assembly mounted on the frame, said at least one roller enabling said trolley to roll along a surface of the track in a longitudinal direction, said connector having a lanyard releasably secured thereto, the lanyard connected to a safety harness to be worn by the person and to suspend the person from said trolley, said trolley immobilizing assembly comprising a movable engagement member and a flexible strap, said strap secured to said movable engagement member, a guide member releasably secured to said frame, said guide member holding said strap in a stowed position wherein said strap is adjacent said lanyard, said movable engagement member being biased in a position away from the track, wherein pulling on said strap separates said guide member from said frame so that said strap hangs from said movable engagement member and causes the movable engagement member to be pulled into engagement with the track thereby releasably fixing said trolley at a fixed longitudinal position on the track so that the person can swing below said trolley while fixed in the fixed longitudinal position on the track, and wherein releasing said strap causes the movable engagement member to return to the biased position thereby releasing the trolley from the fixed longitudinal position on the track so that momentum of the swing of the person moves said trolley along the track to another longitudinal position thereon.

2. The trolley of claim 1 wherein said movable engagement member is a movable frictional engagement member, and wherein pulling on said strap pulls the movable frictional engagement member into frictional engagement with the track to releasably fix said trolley at the fixed longitudinal position on the track.

3. The trolley of claim 1 additionally comprising a retractor coupled to said movable frictional engagement member to retract said strap.

4. The trolley of claim 3 wherein said retractor comprises biased reel.

5. The trolley of claim 1 wherein said strap is secured to the lanyard and wherein said trolley includes a release mechanism for holding said strap in a stowed state until the strap is ready to be used to immobilize said trolley.

6. The trolley of claim 1 wherein said strap is secured to the lanyard.

7. The trolley of claim 6 wherein said guide member holds a first portion of said strap in a substantially horizontal position from said movable engagement member to said guide member and a second portion of said strap in a substantially vertical position from said guide member to said lanyard.

8. The trolley of claim 1 wherein said guide member is releasably secured to said frame by a spring biased finger.

9. The trolley of claim 1 wherein said movable engagement member comprises a pivotable arm normally biased away from the track by a spring mounted on said frame.

10. The trolley of claim 9 additionally comprising at least one other roller mounted on said frame adjacent said pivotable arm.

11. The trolley of claim 9, wherein said at least one trolley immobilization assembly comprises of two trolley immobilization assemblies, where said two trolley immobilization assemblies are respectively mounted on said frame at opposite longitudinal positions with respect to said at least on roller.

12. The trolley of claim 11 additionally comprising at least two other rollers, one of said at least two other rollers being mounted on said frame adjacent said pivotable arm of one of said two trolley immobilization assemblies and another of said at least two other rollers being mounted on said frame adjacent another pivotable arm of the other said two trolley immobilization assemblies.

13. The trolley of claim 12 additionally comprising respective retractors coupled to respective ones of said movable frictional engagement members to retract said strap.

14. A fall arrest safety system comprising a trolley, an elevated track and a lanyard, said trolley being arranged for movement along said elevated track to support a person who has fallen off of a structure adjacent the track, said trolley comprising a frame having at least one roller, a connector mounted on the frame, and at least one trolley immobilizing assembly mounted on the frame, said at least one roller enabling said trolley to roll along a surface of said track in a longitudinal direction, said connector having said lanyard releasably secured thereto, said lanyard connected to a safety harness to be worn by the person and to suspend the person from said trolley, said trolley immobilizing assembly comprising a movable engagement member and a flexible strap, said strap secured to said movable engagement member, a guide member releasable secured to said frame, said guide member holding said strap in a stowed position wherein said strap is adjacent said lanyard, said movable engagement member being biased in a position away from the track, wherein pulling on said strap separates said guide member from said frame so that said strap hangs from said movable engagement member and causes the movable engagement member to be pulled into engagement with the track thereby releasably fixing said trolley at a fixed longitudinal position on said track so that the person can swing below said trolley while fixed in the fixed longitudinal position on said track, and wherein releasing said strap causes the movable engagement member to return to the biased position thereby releasing the trolley from the fixed longitudinal position on said track so that momentum of the swing of the person moves said trolley along said track to another longitudinal position thereon.

15. The fall, arrest system of claim 14 wherein said movable engagement member, is a movable frictional engagement member, and wherein pulling on said strap pulls the movable frictional engagement member into frictional engagement with said track to releasably fix said trolley at the longitudinal position on said track.

16. The fall arrest system of claim 14 additionally comprising a retractor coupled to said movable engagement member to retract said strap.

17. The fall arrest system of claim 16 wherein said retractor comprises a biased reel.

18. The fall arrest system of claim 14 wherein said strap is secured to the lanyard.

19. The fall arrest system of claim 18 wherein said guide member holds a first portion of said strap in a substantially horizontal position from said movable engagement member to said guide member and a second portion of said strap in a substantially vertical position from said guide member to said lanyard.

20. The fall arrest system of claim 14 wherein said guide member is releasable secured to said frame by a spring biased finger.

21. The fall arrest system of claim 14 wherein said movable engagement member comprises a pivotable arm normally biased away from the track by a spring mounted on said frame.

22. The fall arrest system of claim 21 additionally comprising at least one other roller mounted on said frame adjacent said pivotable arm.

23. The fall arrest system of claim 14, wherein said at least on trolley immobilization assembly comprises of two trolley immobilization assemblies, where said two trolley immobilization assemblies are respectively mounted on said frame at opposite longitudinal positions with respect to said at least one roller.

24. The fall arrest system of claim 23 additionally comprising at least two other rollers, one of said at least two other rollers being mounted on said frame adjacent said pivotable arm of one of said two trolley immobilization assemblies and the other of said at least two other rollers being mounted on said frame adjacent another pivotable arm of the other of said two trolley immobilization assemblies.

25. The fall arrest system of claim 24 additionally comprising respective retractors coupled to respective ones of said movable frictional engagement members to retract said strap.

* * * * *